US007258588B2

(12) United States Patent
Yakou et al.

(10) Patent No.: US 7,258,588 B2
(45) Date of Patent: Aug. 21, 2007

(54) METHOD OF MANUFACTURING IMAGE DISPLAY DEVICE

(75) Inventors: Takeshi Yakou, Ibaraki (JP); Masaki Machino, Ibaraki (JP); Takehito Yamaguchi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 11/212,653

(22) Filed: Aug. 29, 2005

(65) Prior Publication Data

US 2006/0046601 A1 Mar. 2, 2006

Related U.S. Application Data

(63) Continuation of application No. 10/693,105, filed on Oct. 27, 2003, now Pat. No. 6,981,905.

(30) Foreign Application Priority Data

Oct. 31, 2002 (JP) ..... 2002-318403
Oct. 21, 2003 (JP) ..... 2003-360743

(51) Int. Cl.
*H01J 9/00* (2006.01)

(52) U.S. Cl. ..... 445/24; 445/25

(58) Field of Classification Search ..... 445/24–25; 313/495–497, 292
See application file for complete search history.

(56) References Cited

U.S. PATENT DOCUMENTS 5,232,549 A 8/1993 Cathey et al. ..... 445/24
5,561,343 A 10/1996 Lowe ..... 313/482
5,717,287 A 2/1998 Amrine et al. ..... 445/24
5,980,346 A 11/1999 Anderson et al. ..... 445/24
6,068,532 A 5/2000 Lai et al. ..... 445/24
6,152,796 A 11/2000 Nakata ..... 445/24
6,176,753 B1 1/2001 Pong et al. ..... 445/24
6,285,977 B1 9/2001 Miyazaki ..... 703/26
6,981,905 B2 * 1/2006 Yakou et al. ..... 445/24

FOREIGN PATENT DOCUMENTS

| | | |
|---|---|---|
| JP | 2-49397 | 2/1990 |
| JP | 7-6142 | 1/1995 |
| JP | 10-302676 | 11/1998 |
| JP | 2000-251676 | 9/2000 |
| JP | 2000-323073 | 11/2000 |
| WO | WO98/28774 | 7/1998 |

* cited by examiner

*Primary Examiner*—Mariceli Santiago
(74) *Attorney, Agent, or Firm*—Fitzpatrick, Cella, Harper & Scinto

(57) ABSTRACT

A method of manufacturing an image display device, having a plurality of spacers for keeping a gap between a pair of substrates, includes the steps gripping each of the spacers at both ends in a longitudinal direction of each spacer, installing the plural spacers on one of the pair of substrates while exerting a tensile force to the gripped plural spacers, and applying an adhesive to the plural spacers installed on the one substrate, to tentatively fix by the adhesive the plural spacers to the one substrate. The adhesive is heated so that the plural spacers tentatively fixed to the one substrate are finally fixed to the one substrate.

8 Claims, 11 Drawing Sheets

METHOD OF MANUFACTURING IMAGE DISPLAY DEVICE

This application is a continuation of application Ser. No. 10/693,105, filed on Oct. 27, 2003 now U.S. Pat. No. 6,981,905 issued Jan. 3, 2006.

BACKGROUND OF THE INVENTION

1. Field of the Invention

The present invention relates to a method of manufacturing an image display device and more specifically to a spacer installing method using a hand for gripping a long spacer in a method of manufacturing a flat panel display with a long spacer (atmospheric pressure support member) interposed between a pair of substrates (a face plate and a rear plate) that constitute a display panel.

2. Description of the Related Background Art

A conventional flat panel display has a pair of substrates (plates) composed of a face plate and a rear plate, and forms and displays an image by projecting electron beams, which are emitted from electron-emitting devices forming a matrix pattern on the rear plate side, at phosphors, which are formed on the face plate side. In this image display device, a space between the pair of plates is kept at a vacuum and therefore several long spacers are provided at regular intervals in order to support an atmospheric pressure applied to the plates.

Manufacture of this type of flat panel display, one with a plurality of long spacers interposed between a pair of plates, employs a method in which the long spacers are picked and installed one at a time in order to join the long spacers with high accuracy. In a different technical field, a method of simultaneously gripping plural objects with an array of hands for a given work (e.g., transporting and boxing plural objects at once) has been disclosed (see Japanese Patent Application Laid-Open No. H07-6142, for example).

The technique of the prior art example, which uses object gripping hands to grip plural objects simultaneously for a given work, is unfit to be used in manufacture of a flat panel display as the one described in the above since it is difficult for the technique to meet the following requirements:

1) Both ends of a long spacer, which is a long, pliant object, are gripped.

2) The long spacer is given a certain level of tension.

3) The hands on both end sides of the long spacer conform to irregularities of a surface on which the long spacer is to be placed.

4) A load that is in contact with the surface on which the long spacer is to be placed is necessarily minimized.

5) A plurality of hands that meet the above requirements 1) through 4) are lined up to simultaneously grip a plurality of long spacers and install the long spacers at once with high accuracy (in a pitch direction).

The object gripping hands of the above-described prior art example fall short of satisfying the above requirements, and it is particularly difficult for the conventional hands to meet the requirement 5) concerning high precision installation.

SUMMARY OF THE INVENTION

The present invention has been made in view of such conventional circumstances, and an object of the present invention is therefore to provide a method of manufacturing an image display device in which long spacers are efficiently joined between a pair of substrates with high accuracy by simultaneously gripping the spacers in an array of hands and simultaneously installing the spacers with high accuracy. The hands are paired and each pair grips both ends of one spacer. The hands apply a certain level of tension to the spacers. The hands on each end conform to surface irregularities of a face on which the spacers are to be placed, thereby minimizing a load that is in contact with the face on which the spacers are to be placed.

In order to attain the above object, a method of manufacturing an image display device according to the present invention relates to a method of manufacturing an image display device that has plural spacers for regulating a gap between a pair of substrates, including: gripping the plural spacers; and installing the gripped plural spacers on one substrate of the pair of substrates, characterized in that, in the gripping of the plural spacers, each of the plural spacers is gripped in a pair of hands with each hand of each pair gripping one end in a longitudinal direction of one spacer. Thus, each of the above requirements 1) through 4) are met and therefore it becomes possible to meet the requirement 5) concerning high precision installation.

DESCRIPTION OF THE PREFERRED EMBODIMENTS

An embodiment of a method of manufacturing an image display device in accordance with the present invention is described below with reference to FIGS. 1 to 16.

First, an image display device to be manufactured by the manufacture method according to this embodiment is outlined. This image display device has, as a pair of substrates (plates) facing each other, a rear plate on which electron-emitting devices form a matrix pattern and a face plate on which phosphors are formed at positions opposing the electron-emitting devices on the rear plate. The electron-emitting devices on the rear plate project electron beams at the opposing phosphors on the face plate, thereby causing the phosphors to emit light. The space between the plates in this image display device is in a vacuum and therefore spacers (long spacers) are provided to support the atmospheric pressure applied to the plates.

Figure 1:
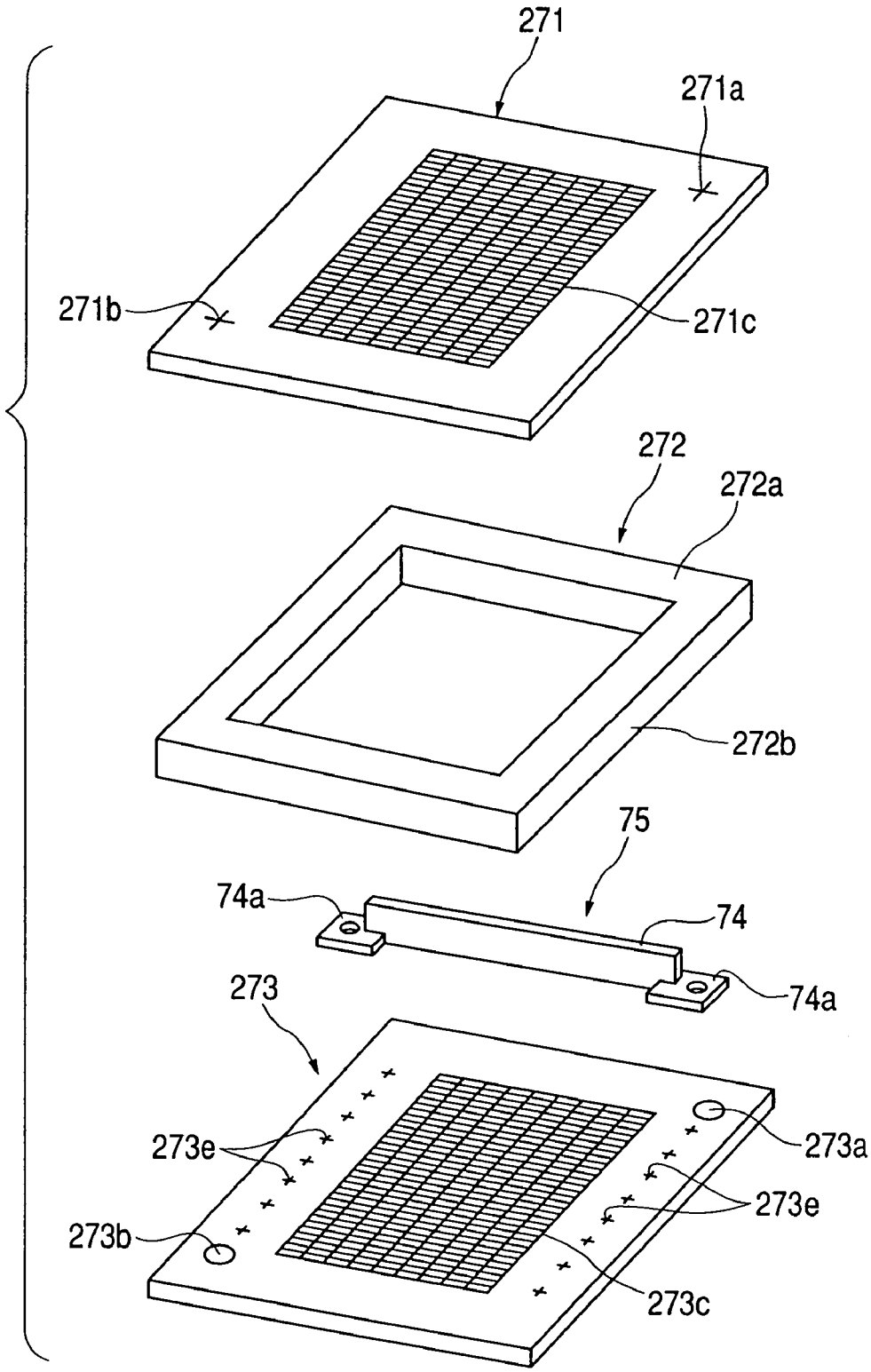
FIG. 1 is an exploded view of the image display device.
Figure 2:
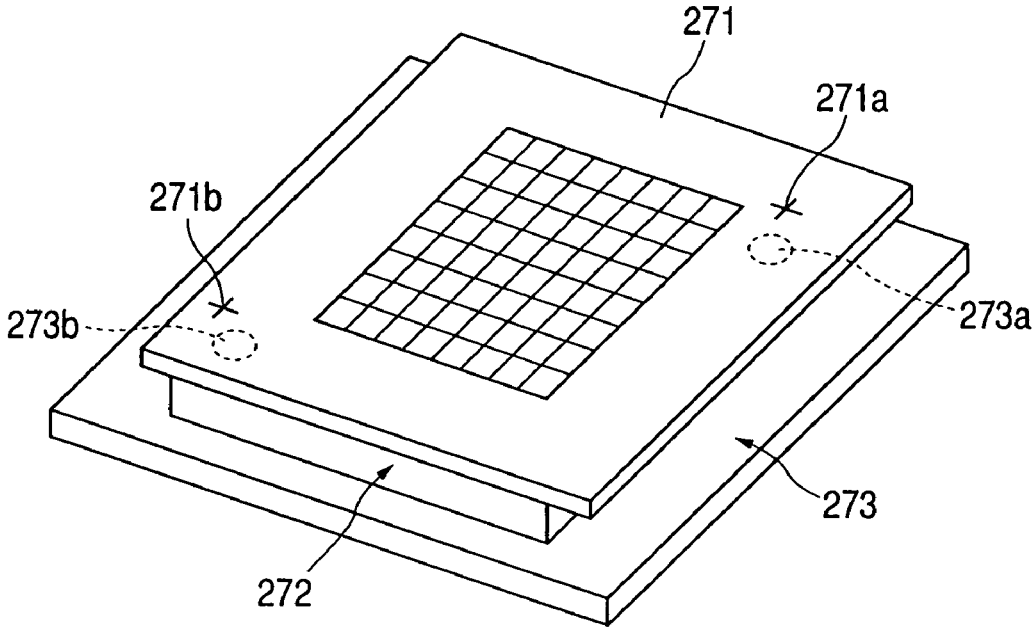
FIG. 2 is a diagram showing the image display device assembled.
Figure 3:
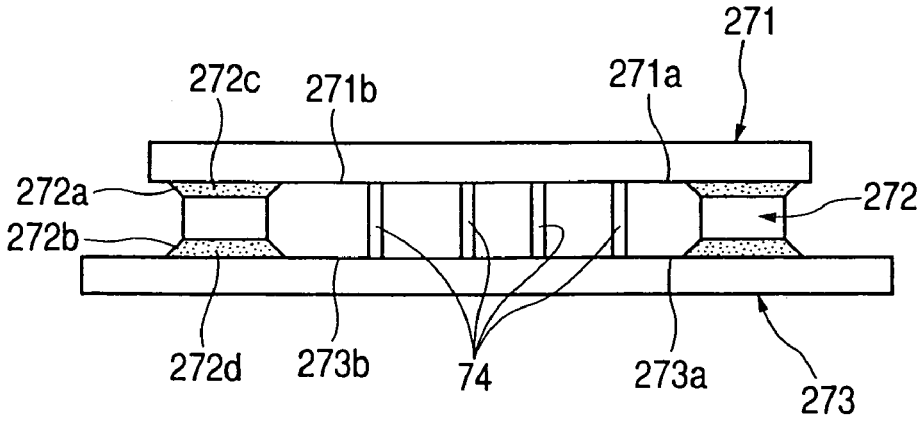
FIG. 3 is a sectional view of the image display device.

FIG. 1 is an exploded view of the image display device. FIG. 2 is a perspective view of the image display device assembled and completed. FIG. 3 is a sectional view of the completed image display device.

In FIGS. 1 to 3, Reference Symbol 271 denotes a glass face plate on which phosphors 271*c* and a black matrix are formed. Denoted by 271*a* and 271*b* are alignment marks on the glass face plate 271. Reference Symbol 272 denotes a frame body, and 272*a* and 272*b* denote glass frit of the frame body 272. Denoted by 74 is a spacer serving as an atmospheric pressure support member. The spacer 74 has its both ends joined to bridges (auxiliary members for supporting the spacer) 74*a* and 74*a* in advance using a ceramic adhesive. Reference Symbol 75 denotes a spacer unit composed of the spacer 74 and the bridges 74*a* and 74*a*.

Denoted by 273 is a glass rear plate. Reference Symbols 273*c* are electron-emitting devices forming a matrix pattern on the glass rear plate 273. 273*e* is a spacer alignment mark, which indicates where to join a spacer on the glass rear plate 273 and which is formed at a position corresponding to each end of the spacer. Denoted by 273*a* and 273*b* are alignment marks, which are provided on the glass rear plate 273 for positioning and which correspond to the alignment marks 271*a* and 271*b* on the glass face plate 271.

In the above image display device, the spacers 74 provided between the glass face plate 271 and the glass rear plate 273, which are a pair of substrates, support the atmospheric pressure applied to the plates 271 and 273 (see FIG. 3).

Figure 4:
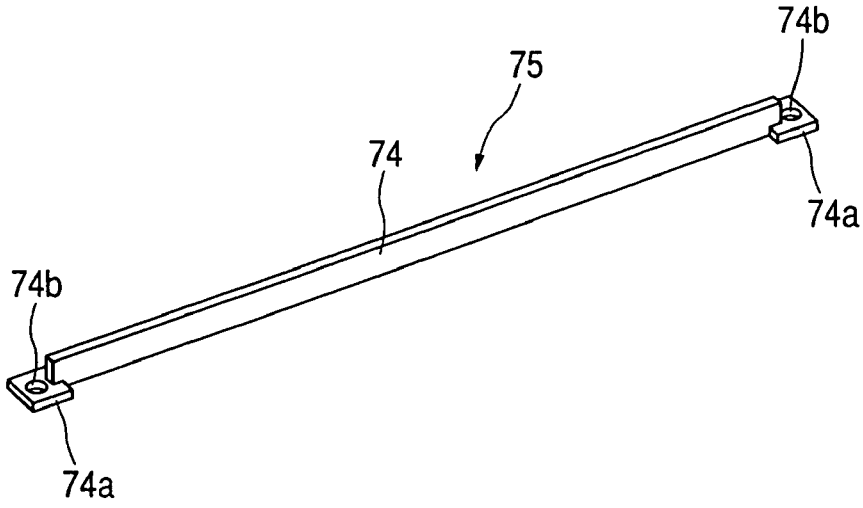
FIG. 4 is a perspective view showing a spacer unit.

FIG. 4 shows details of the spacer unit 75. The spacer 74 in the spacer unit 75 is a glass spacer having a belt-like shape, which measures, for example, 0.2 mm in thickness and 2 mm in height. The bridge 74*a* is joined to each end of the spacer 74 in advance using a ceramic adhesive.

Figure 5:
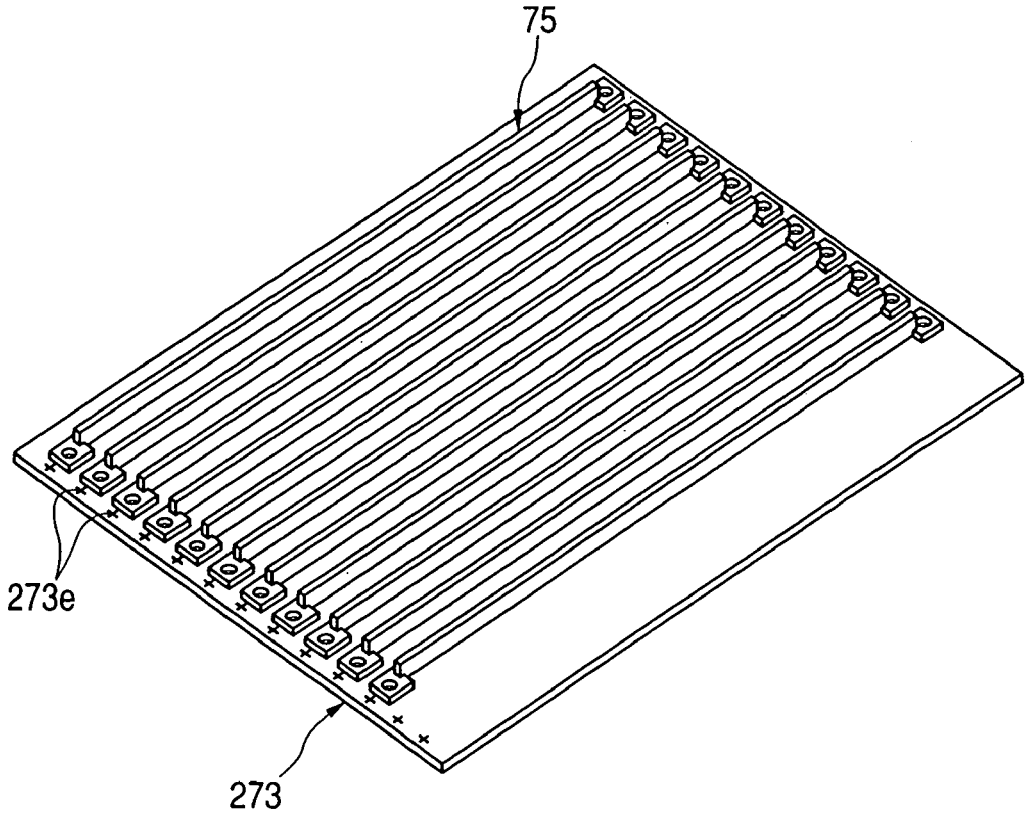
FIG. 5 is a perspective view showing how the spacer unit is joined to a top face of a rear plate.

FIG. 5 shows the spacer units 75 joined to a top face of the rear plate 273. The spacer unit 75 is centered in its thickness direction along a line that connects one spacer alignment mark 273*e* on the rear plate 273 and the opposite spacer alignment mark 273*e*. The thus positioned spacer unit 75 is joined to the top face of the rear plate 273 by bonding the bridges 74*a* and 74*a* at given positions outside the image display area using a ceramic adhesive. In joining the spacer unit 75 to the rear plate 273, a certain level of tension is applied to the spacer 74 in order to straighten the spacer 74 (more will be described later).

Referring to FIGS. 6 to 16, descriptions are given on a method of manufacturing the above image display device and on a spacer joining device (also called a spacer installing device or spacer assembling device) used in the manufacture method.

Figure 6:
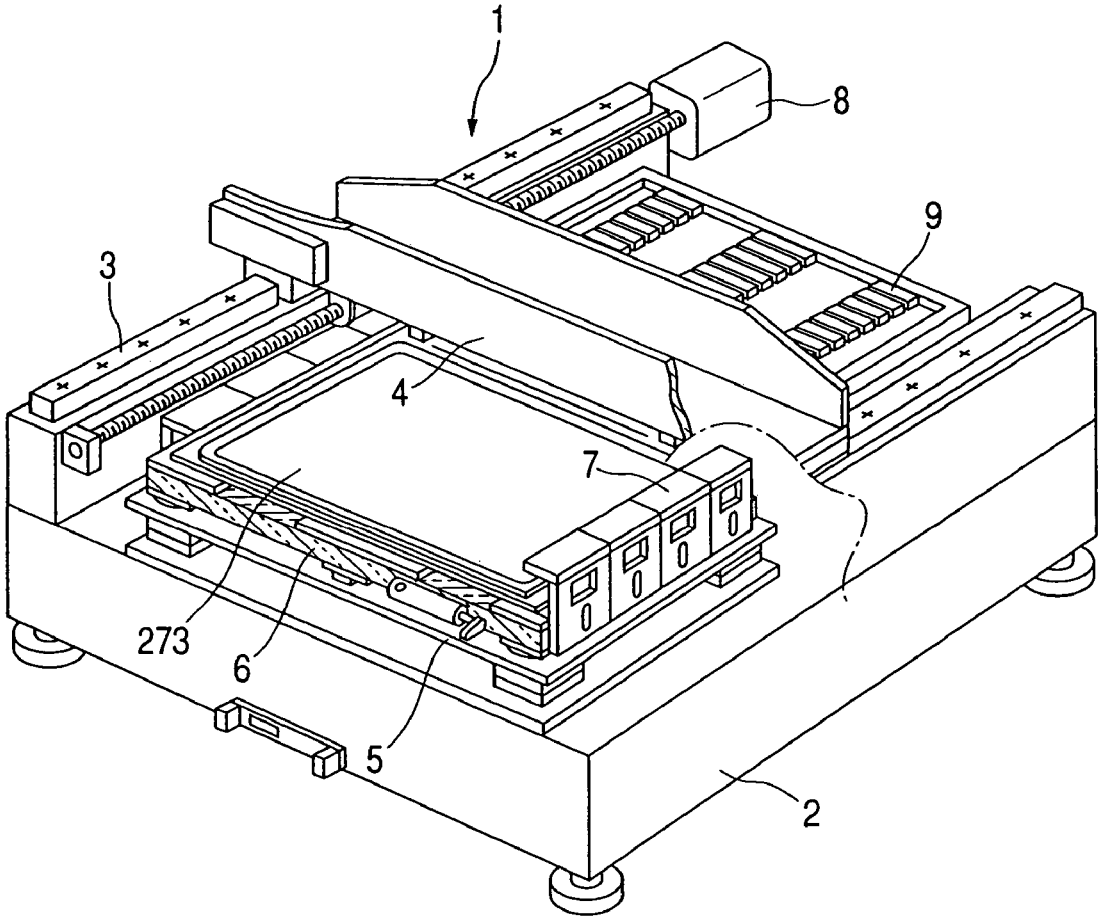
FIG. 6 is a perspective view showing an exterior of a spacer joining device for use in a method of manufacturing an image display device according to the present invention.

FIG. 6 is a perspective view showing an entirety of a spacer joining device, which is used in a step of gripping the spacer 74 to install and join the spacer 74 to the top face of the rear plate 273. In FIG. 6, Reference Symbol 1 denotes the spacer joining device and 2 denotes a stand. A column guide (linear guide) 3 is attached to each side of the stand 2. Denoted by 4 is a column (moving column) that can move along the linear guide 3. The column 4 is numerically controlled and driven by a moving mechanism that is composed of a servomotor 8 and a ball screw upon receiving a control command from a not shown numerical control unit (hereinafter referred to as NC driving). Attached to the column 4 is a hand unit composed of a plurality of hands for mechanically gripping, positioning, and installing the spacers 74 (for the hand unit, see a description below). Reference Symbol 9 denotes a spacer magazine (a magazine for the spacer units) for storing as many spacer units 75 as necessary for one panel. Denoted by 5 is an XYθ table, the movement of which is controlled with the spacer alignment marks 273*e* that are captured by image processing cameras (see a description below) as the reference. Reference Symbol 6 denotes a rear plate jig on which the rear plate 273 is placed, and 7 denotes a spacer hold-down mechanism.

Operations of the spacer joining device 1 are described.

First, the rear plate jig 6 is taken out to the outside from the spacer joining device 1 to place the rear plate 273 on the rear plate jig 6. Then, the rear plate jig 6 on which the rear plate 273 is placed is returned to the spacer joining device 1 and put on the XYθ table 5. The spacer magazine 9 in which a necessary number of spacer units are stored in advance is set at a given position in the spacer joining device 1.

The steps up through setting the spacer magazine 9 are carried out by a worker. The subsequent steps are automatic operations. The automatic operations are started by a driving unit 8 moving the column 4 to the point where the spacer magazine 9 stores the spacer units. The hands in the hand unit, which is placed above the column 4 and which is described later, are paired so that both end portions of each of the spacers 74 are simultaneously gripped by each pair. Thereafter, the column 4 is moved onto the rear plate 273 and a tension is applied to the spacers 74 (details of the gripping hand unit are described later). The image cameras (more will be described later) placed above the column 4 capture the spacer alignment marks 273*e* on the rear plate 273 to position the rear plate 273 in relation to the hands using the XYθ table 5.

Thereafter, the hands are lowered until the bottom end portions of the spacers 74 are brought into contact with the top face of the rear plate 273. Then, the spacer hold-down mechanism 7 presses down on both end portions of the spacer 74 in order to avoid mechanical misalignment and to maintain the tension (details of the spacer hold-down mechanism 7 will be described later). Through repetition of those works, a given number of spacers 74 are installed on the rear plate 273. After the installation is completed, the rear plate 273 is taken out of the device 1 along with the rear plate jig 6.

Then, a ceramic adhesive is applied to an adhesive hole 74*b* formed in each bridge 74*a* of the spacer unit 75 shown in FIG. 4 by means of transfer needles of an adhesive transfer device (not shown in the drawing). After that, the rear plate jig 6 is put in a vacuum chamber to cure the adhesive through vacuum drying (for details of vacuum drying, see a description below). The rear plate jig 6 is then taken out of the vacuum chamber to remove the rear plate 273, to which the spacers 74 are now joined, from the rear plate jig 6 in preparation for the next step.

Through the above steps, a given number of spacers 74 are joined to the top face of the rear plate 273 at given positions. In this example, five spacers 74 are installed at a time and the installation is repeated four times to install twenty spacers 74 in total. The spacers are then fixed by the spacer hold-down mechanisms 7. The present invention thus makes it possible to install plural spacers in one work step by using a hand unit with several pairs of hands and therefore can reduce the number of work steps in installing the spacers.

Next, a description is given with reference to FIGS. 7 to 10 and FIGS. 11A to 11C on details of the hand unit used in the step of gripping and installing the spacers 74 out of the steps described above.

The hand unit has pairs of hands and each pair grips both ends of one spacer 74. In this embodiment, a fixed hand that is stationarily placed on the column 4 and a tension applying hand that is placed on the column 4 in a movable manner constitute one pair. The pairs of hands simultaneously grip and install the plural spacers 74 and therefore the number of spacers to be installed at a time dictates the number of pairs of hands to be mounted to the hand unit.

Figure 7:
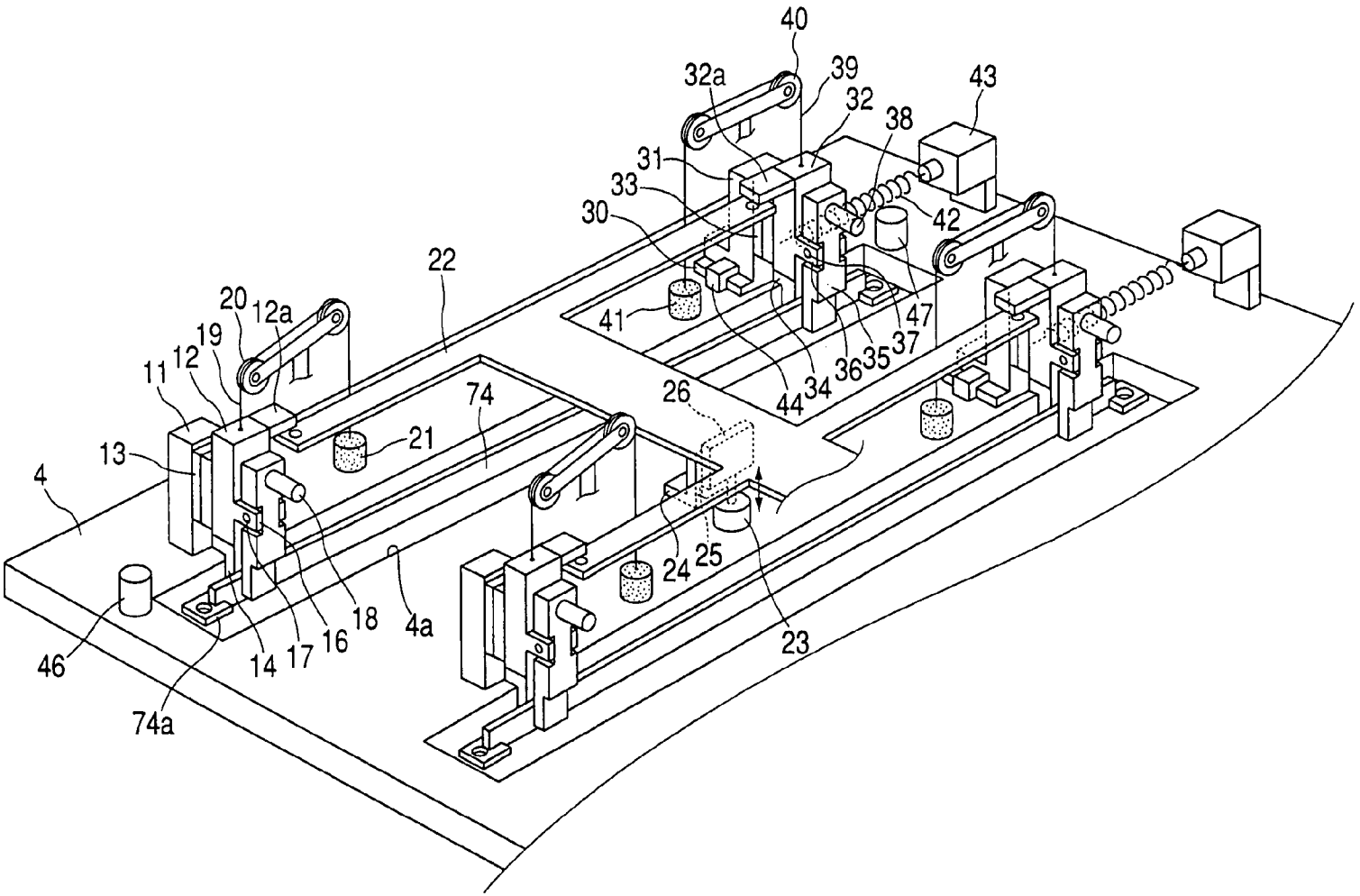
FIG. 7 is a perspective view showing an overall structure of a hand unit.
Figure 8:
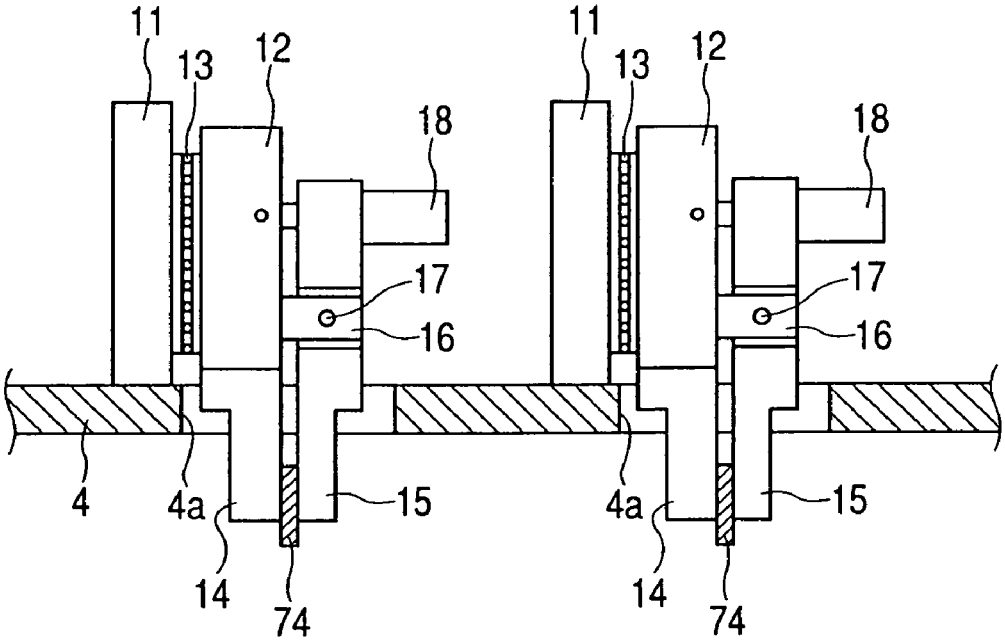
FIG. 8 is a side view showing fixed hands.
Figure 9:
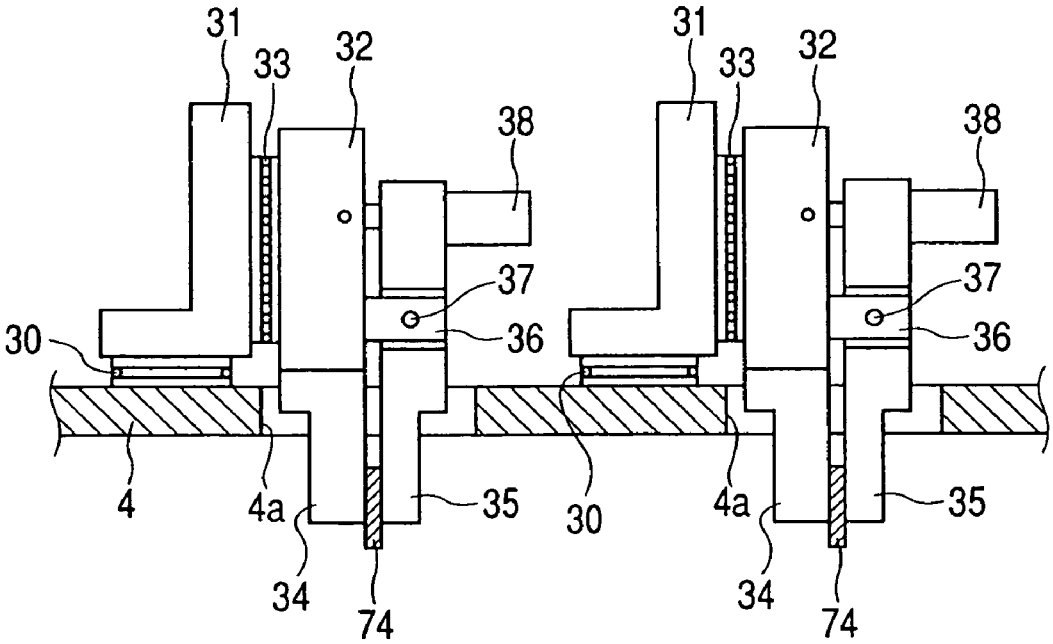
FIG. 9 is a side view showing tension applying hands.
Figure 10:
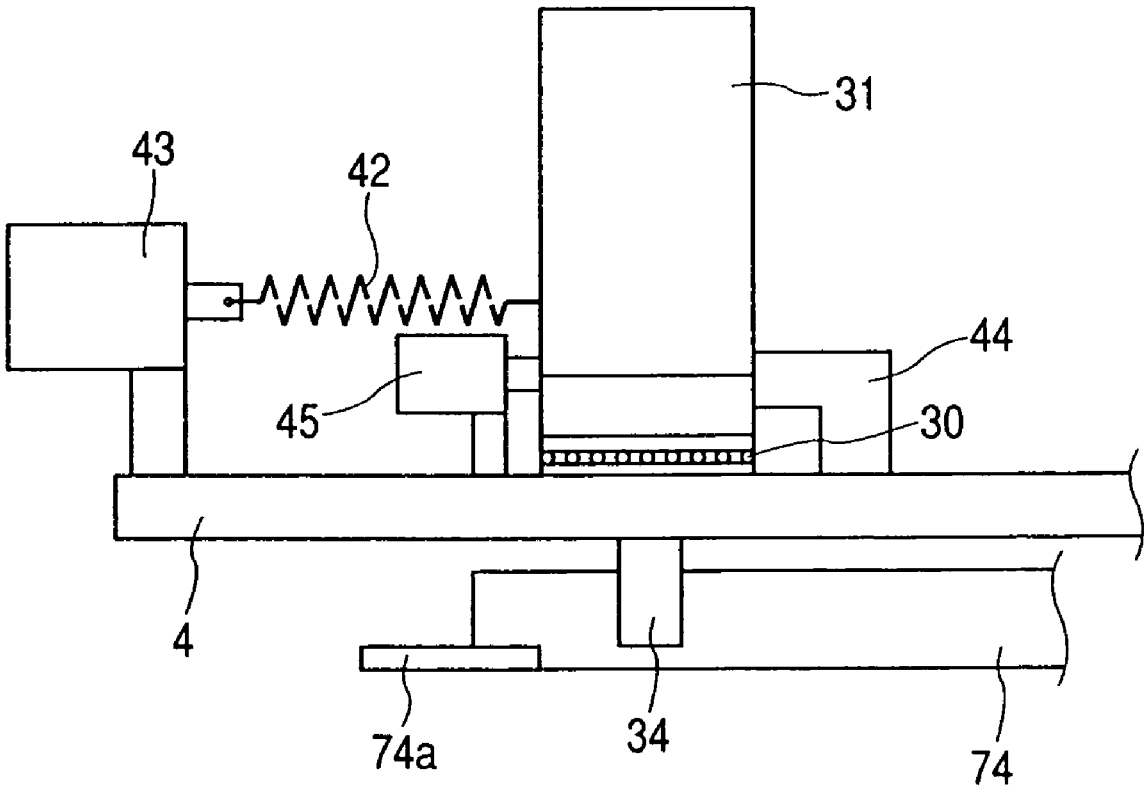
FIG. 10 is a side view showing a tension applying mechanism by the tension applying hands.

FIG. 7 is a perspective view showing a pair of hands placed on the column 4. FIG. 8 is a sectional view showing a fixed hand of the pair of gripping hands. FIG. 9 is a sectional view showing a tension applying hand of the pair of gripping hands. FIG. 10 is a detailed diagram of a tension applying mechanism by the tension applying gripping hand.

In FIGS. 7 to 10, denoted by 4*a* is a hole formed in the top face of the column 4 described above. A claw portion (see a description below) of a hand can be driven within the hole 4*a*. In FIGS. 7 and 8, denoted by 11 to 21 are components related to a fixed hand and to a mechanism of driving the fixed hand. Reference Symbol 11 represents a supporting post (fixed supporting post), which supports the fixed hand and is fixed at a given position adjacent to the hole 4*a* on the column 4. Reference Symbol 12 represents a fixed plate, which constitutes the main body of the fixed hand. The fixed plate 12 is guided along an upper and lower guide 13, which is provided on a side face of the supporting post 11 on the side of the hole 4*a*, to move in and out of the hole 4*a* in the vertical direction. Denoted by 14 is a fixed claw of the fixed hand, and the fixed claw is attached to the leading end of the fixed plate 12. Denoted by 15 is a movable claw of the fixed hand. 16 represents a rotation support portion for supporting the movable claw 15 rotatably on a side face of the fixed plate 12. Denoted by 17 is a pin inserted into a hole in a rotation axis of the rotation support portion 16. The movable claw 15 swings in a given angle range about the rotation axis of the rotation support portion 16 through the pin 17, thereby opening and closing the fixed hand. Denoted by 18 is a gripping cylinder, which is an air cylinder for swingably driving the movable claw 15 through the rotation support portion 16. The cylinder 18 opens and closes the movable claw 15 by pneumatically moving a rod back and forth. The power used to grip the spacer 74 is about 3 kg, for example. Reference Symbol 19 represents a wire and 20 represents a pulley about which the wire is wound. One end of the wire 19 is connected to the fixed plate 12 whereas the other end is wound around the pulley 20 and then connected to a plummet 21. With this structure, the self-weight of the fixed hand is reduced, and when the fixed hand weighs a few kilograms, for example, the weight is reduced to several hundreds grams.

In FIGS. 7, 9, and 10, represented by 30 to 45 are components of the tension applying hand and of a mechanism for driving the tension applying hand. Denoted by 31 is a supporting post (fixed supporting post) for supporting the tension applying hand. The supporting post 31 is attached in a manner that makes the supporting post 31 movable on the column 4 along the longitudinal direction of the spacer 74 through a linear guide 30. Denoted by 32 is a fixed plate, which is the main body of the tension applying hand and is guided in the vertical direction by an upper and lower guide 33. Reference Symbol 34 represents a fixed claw of the tension applying hand and the fixed claw 34 is attached to the leading end of the fixed plate 32. Denoted by 35 is a movable claw of the tension applying hand. 36 represents a rotation support portion for supporting the movable claw 35 rotatably on a side face of the fixed plate 32. Denoted by 37 is a pin inserted into a hole in a rotation axis of the rotation support portion 36. The movable claw 35 swings in a given angle range about the rotation axis of the rotation support portion 36 through the pin 37, thereby opening and closing the tensile force applying hand at fixed side. Denoted by 38 is a gripping cylinder, which is an air cylinder for swingably driving the movable claw 35 through the rotation support portion 36. The cylinder 38 opens and closes the movable claw 35 by pneumatically moving a rod back and forth. Reference Symbol 39 represents a wire and 40 represents a pulley about which the wire is wound. One end of the wire 39 is connected to the fixed plate 32 whereas the other end is wound around the pulley 40 and then connected to a plummet 41. With this structure, the self-weight of the tension applying hand is reduced, and when the tension applying hand weighs a few kilograms, for example, the weight is reduced to several hundreds grams.

To summarize, the tension applying hand and the fixed hand have an identical claw structure. The difference between the two types of hands is that the supporting post 31 is attached to the column 4 through the linear guide 30 to thereby make the entire tension applying hand movable in the longitudinal direction of the spacer 74. Specifically, as shown in FIGS. 7 and 10, the supporting post 31 is guided by the linear guide 30, and as a tension applying cylinder (air cylinder) 43 works on a tension coil spring 42 attached to the supporting post 31, a spring force of several hundreds grams, for example, is applied. Denoted by 44 is a stopper. The leading end of a rod of a stopper cylinder (air cylinder) 45 presses the supporting post 31 against the stopper 44 for positioning.

In this embodiment, five pairs of such hands are attached (only two pairs out of the five pairs are shown in the example of FIG. 7). The fixed claws 14 of the fixed hands are installed with as high pitch accuracy as 2 μm. The fixed claws 34 of the tension applying hands are also installed with the same pitch accuracy.

In FIG. 7, denoted by 22 to 26 are components of a driving mechanism for moving a pair of hands, namely, a fixed hand and a tension applying hand, up and down. 22 represents an upper and lower hand bar (upper and lower hand plate) with a flat shape obtained by coupling a bar that connects one pair of hands with a bar that connects another pair of hands at the center between the two pairs of hands. A top face of the upper and lower hand bar 22 is in contact with bottom faces of shoulder members 12*a* and 32*a*, which protrude from side faces of upper end portions of the fixed plates 12 and 32, respectively. With the upper and lower hand bar 22 kept in contact with the shoulder members 12*a* and 32*a*, the fixed plates 12 and 32 can be moved upward through the shoulder members 12*a* and 32*a*. A mechanism for moving the upper and lower hand bar 22 is composed of an air cylinder 23, an angle member 24, and a vertical guide 25. The air cylinder 23 serves as a drive source for driving the upper and lower hand bar 22 upward and downward. The angle member 24 is attached to a top face of the column 4. The vertical guide 25 is provided on a side face of the angle member 24. A rod of the air cylinder 23 is moved up and down to drive the upper and lower hand bar 22 upward and downward along the vertical guide 25 of the angle member 24, thereby lifting and lowering the hand unit. The air cylinder 23 may be replaced by a servomotor or a similar drive source.

Denoted by 46 and 47 are CCD cameras for image processing. The CCD cameras 46 and 47 are set, for example, in the periphery of the central pair out of the five pairs of hands. Since the spacer 74 is centered in the thickness direction along a line that connects one spacer alignment mark 273*e* on one end of the rear plate 273 and the opposite spacer alignment mark 273*e* on the other end, a line running between the spacer gripping faces of the fixed claws 14 and 34 of the central pair has to be positioned at a given distance (e.g., 0.1 mm if the spacer is 0.2 mm in thickness) from the line that connects the alignment marks. The image processing devices are adjusted as described above in advance and positioned by the XYθ table 5.

Now, operations of the hand unit are described. The "hand unit (gripping hand unit)" in this description refers to portions that are moved up and down through the upper and lower hand bar 22 by the cylinder 23, which drives the upper and lower hand bar. Specifically, the hand unit means portions that move along the upper and lower guides 13 and 33 with respect to the supporting posts 11 and 31, and include the fixed plates 12 and 32, the fixed claws 14 and 34, the movable claws 15 and 35, the rotation support portions 16 and 36, the pins 17 and 37, and the air cylinders 18 and 38.

In the initial state before gripping the spacers 74, the hand unit is positioned at the top ends of the supporting posts 11 and 31 by the cylinder 23 for driving the upper and lower hand bar. The movable claws 15 and 35 are opened at this point. The stopper cylinder 45 is pressing the supporting post 31 of the tension applying hand against the stopper 44, and the tension coil spring 42 is yet to apply a tension.

From the initial state described above, the following operations (1) to (14) are carried out:

(1) NC driving of the servomotor 8 causes a feed screw mechanism to move the column 4 to a position above the five spacers 74 in the spacer magazine 9. With the column 4 placed at this position, the cylinder 23 for driving the upper and lower hand bar is driven to lower the rod of the cylinder 23 to the descent end. This lowers the hand unit along the upper and lower guides 13 and 33 with respect to the supporting posts 11 and 31 through the upper and lower hand bar 22.

(2) With the hand unit lowered, the air cylinders 18 and 38 are driven and the rods of the air cylinders 18 and 38 are extended to close the movable claws 15 and 35. In this way, both end portions of the spacers 74 are held between the fixed claws 14 and 34 and the movable claws 15 and 35. In this state, the cylinder 23 for driving the upper and lower hand bar is driven to lift the hand unit through the upper and lower hand bar 22.

(3) NC driving of the servomotor 8 causes the feed screw mechanism to move the column 4 to a spacer joining position on the rear plate 273 (an upper position corresponding to five spacers).

(4) The stopper cylinder 45 is driven to retract the rod of the cylinder 45 (see FIG. 10).

(5) The tension applying cylinder 43 is driven to retract the rod of the cylinder 43, and the tension applying hands are moved on the column 4 along the linear guide 30 through the tension coil spring 42. A tensile force is thus applied to the spacers 74.

(6) The cylinder 23 for driving the upper and lower hand bar is driven to lower the hand unit to a point by a claw of the spacer hold-down mechanism 7 (see a description below) where the hand unit does not come into contact with the rear plate 273. In this state, the servomotor 8 is driven by NC driving to cause the feed screw mechanism to move the column 4 and bring the spacer 74 under the claw of the spacer hold-down mechanism 7.

(7) The image processing cameras 46 and 47 capture the alignment marks 273*e*, and the spacers 74 are positioned by the XYθ table 5 such that the spacers 74 are centered in the thickness direction along the lines that connect the alignment marks on one end to the alignment marks on the other end.

(8) The cylinder 23 for driving the upper and lower hand bar is driven to lower the hand unit through the upper and lower hand bar 22.

Figure 11A:
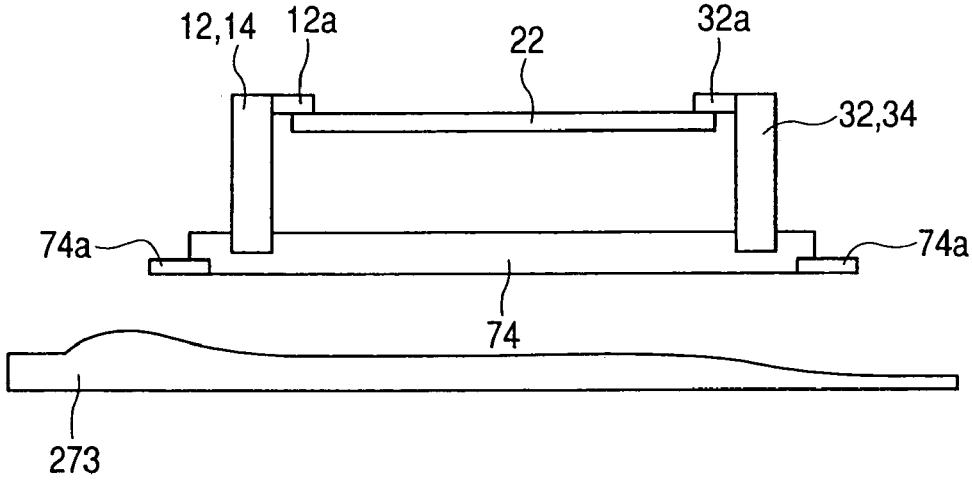
FIGS. 11A, 11B, and 11C are frontal views showing how a spacer is brought into contact with the rear plate.
Figure 11B:
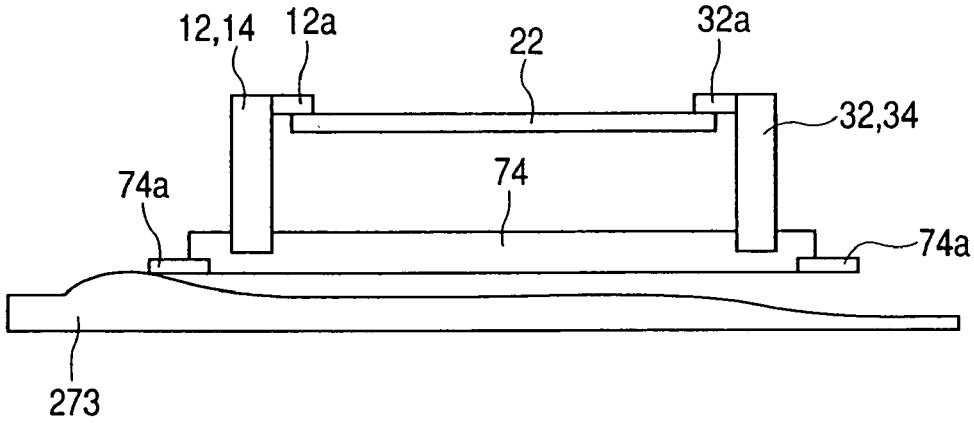
Figure 11C:
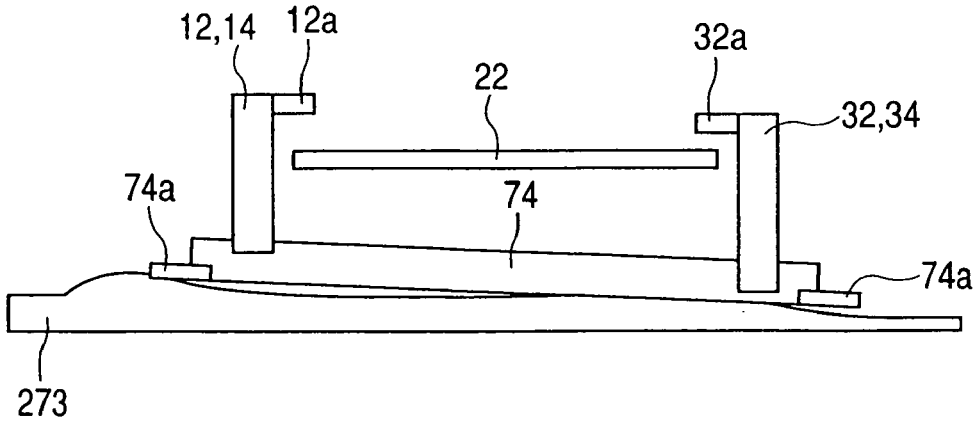

FIGS. 11A to 11C show the descent of the hand unit (movement in a direction of a normal line of the rear plate 273). A contact surface of the rear plate 273 where the spacers are brought into contact with the rear plate 273 may be irregular depending on the glass plate thickness accuracy and on the thickness accuracy of objects (wires, for example) formed thereon. FIG. 11A shows the rear plate 273 before a bottom face of the spacer 74 is brought into contact with the surface of the rear plate 273. FIG. 11B shows one hand (the fixed hand in the example shown in the drawings) out of a pair of hands having been brought into contact with the top face of the rear plate 273 by descent of the upper and lower hand bar 22. The vertical movement of this hand is stopped once the hand comes into contact with the rear plate 273. FIG. 11C shows a further descent of the upper and lower hand bar 22 with the result that the other hand (the tension applying hand in the example shown in the drawings) of the pair is brought into contact with the top face of the rear plate 273. Through those operations, the bottom face of the spacer 74 is securely brought into contact with the rear plate 273 while conforming to the surface irregularities (fluctuation in thickness) of the rear plate 273.

(9) The spacer hold-down mechanism 7 presses down on the spacer 74 (see a description below).

(10) The tension applying cylinder 43 is driven to put the rod of the cylinder 43 forward and release the tension that has been applied to the spacer 74 through the tension coil spring 42 and the tension applying hand.

(11) The air cylinders 18 and 38 are driven to open the movable claws 15 and 35.

(12) The cylinder 23 for driving the upper and lower hand bar is driven to lift the hand unit through the upper and lower hand bar 22.

(13) The stopper 45 of the tension applying hand is put into effect.

(14) The above operations (1) through (12) are repeated four times in total (if twenty spacers are to be installed).

In this way, the spacers 74 are fixed on the rear plate 273 by the spacer hold-down mechanisms 7 with high accuracy.

Details of the spacer hold-down mechanism 7 are described next with reference to FIGS. 12 to 13 and FIGS. 14A to 14B.

Figure 12:
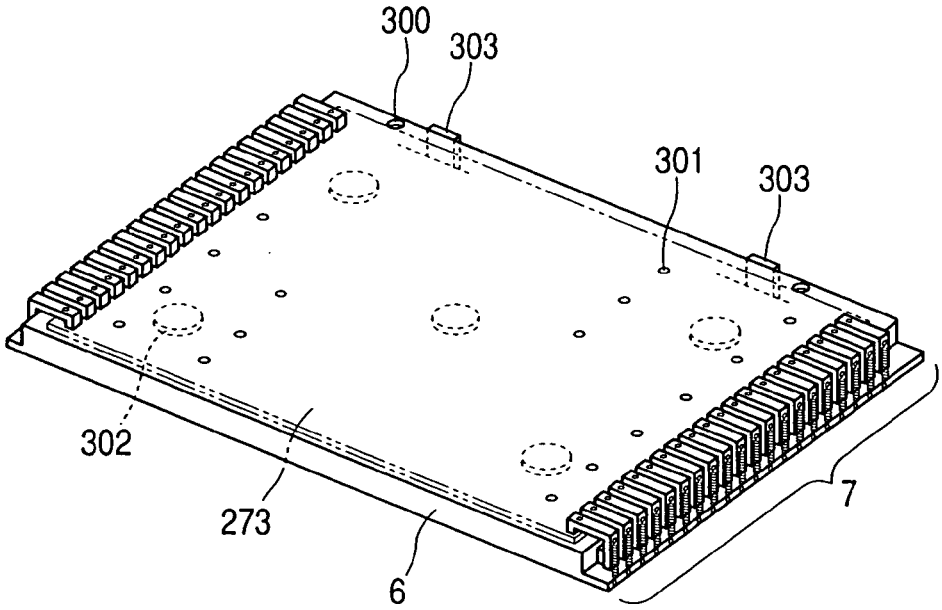
FIG. 12 is a perspective view showing a rear plate jig, which is provided with a spacer hold-down mechanism.
Figure 13:
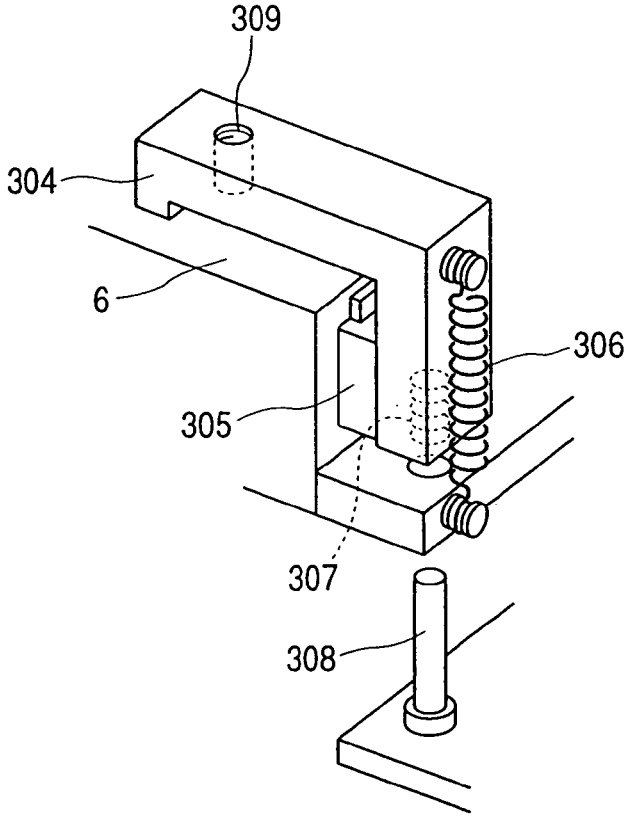
FIG. 13 is a perspective view showing details of the spacer hold-down mechanism.
Figure 14A:
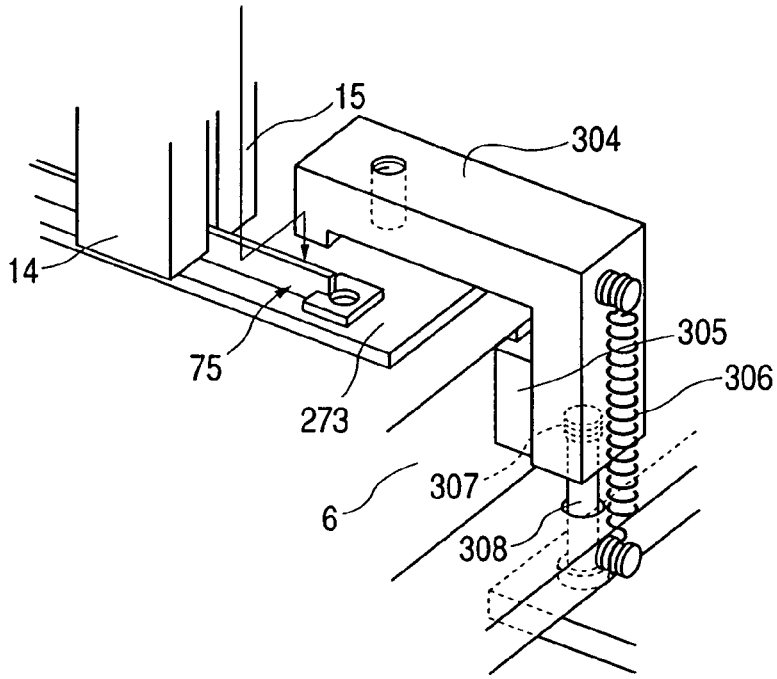
FIGS. 14A and 14B are perspective views illustrating a change in state of the spacer hold-down mechanism.
Figure 14B:
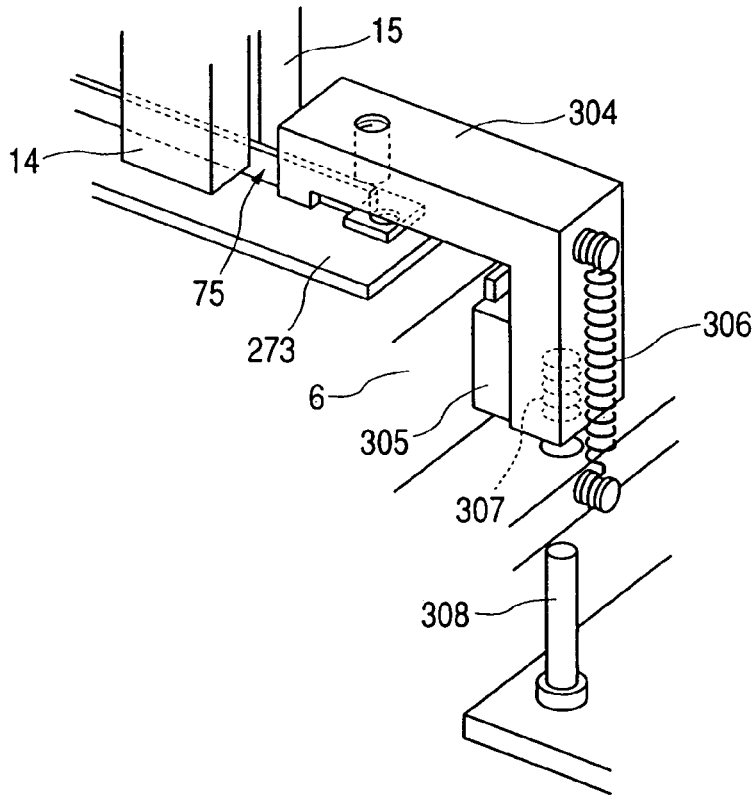

FIG. 12 is a perspective view showing the spacer hold-down mechanism 7 and the rear plate jig 6. FIG. 13 is a perspective view showing details of the spacer hold-down mechanism 7. FIGS. 14A and 14B are perspective views showing how the spacers 74 are held down by the spacer hold-down mechanisms 7.

As shown in FIG. 12, a stage of the rear plate jig 6 has a contour similar to that of the rear plate 273. A rear plate positioning reference 300 for determining the arrangement of the rear plate 273, suction holes (suction mechanism) 301 for fixing, and others are provided on the top face of the stage, so that the rear plate 273 is fixed flatly without being distorted.

The rear plate jig 6 is provided with a height receiving face member 302 for determining the position of the rear plate jig 6 in the height direction with respect to the spacer joining device 1 and a jig positioning reference member (positioning reference plane) 303. The height receiving face member 302 and jig positioning reference member 303 are therefore replaceable.

The number of spacer hold-down mechanisms 7 which is at least equal to or more than the number of spacers 74 are arranged along two opposing sides out of four sides that constitute the perimeter of the stage of the rear plate jig 6. The spacer hold-down mechanisms 7 are placed at positions where the ends of the spacers 74 are fixed by the adhesive.

As shown in FIG. 13, the spacer hold-down mechanism 7 fixes, to the top face of the rear plate (glass substrate) 273, a portion of the spacer 74 that extends outward from the hand that grips and transports the spacer 74 while maintaining the tension applied to the spacer 74. Each spacer hold-down mechanism 7 has a claw 304 which presses down on the top face of the exposed portion of the spacer 74 at each end, and a guide 305 which guides the vertical motion of the claw 304. The guide 305 is placed on a side face of the stage of the rear plate jig 6.

The spacers 74 may be fluctuated in height, and the wire plane level on the substrate may also be varied. Accordingly, the guide 305 is structured such that, when the spacer hold-down mechanisms 7 press down on the spacers 74 simultaneously, the claws 304 can be moved separately to different levels to suit the varying heights of the spacers 74.

The claw 304 presses the spacer 74 utilizing a frictional force, which is generated between the bottom face of the spacer 74 and the top face of the rear plate 273, to resist the tension applied to make the spacer 74 maintain a linear posture and stand by itself.

The face of the claw 304 that is in contact with the spacer 74 is parallel to the top face of the substrate in order to avoid generating a vector that causes the spacer 74 to fall down when pressed. The claw 304 is brought into contact with the spacer 74 by a small force at first, and then the claw 304 presses the spacer 74 with a force that is increased in stages until it becomes large enough to maintain the tension.

This embodiment shows an example of using a spring to generate a hold-down force for the spacer hold-down mechanism 7. As shown in FIGS. 13, 14A, and 14B, the hold-down claw 304 is attached in a manner that allows the claw 304 to move up and down through the guide 305 placed on the plate side face of the rear plate jig 6. One end of a first tension spring 306 is fixed to a side face of the hold-down claw 304. The other end of the first tension spring 306 is fixed to the plate side face of the rear plate jig 6. In this way, a hold-down force F1 of the hold-down claw 304 is obtained through the first tension spring 306.

A second compression spring 307 is also attached to the hold-down claw 304. The second compression spring 307 is placed in a manner that makes it possible for a hold releasing rod 308, which is attached to the spacer joining device 1, to come into contact with the second compression spring 307. While the rod 308 is in contact with the spring 307, a force F2 works in a direction that cancels out the hold-down force generated by the first tension spring 306.

In addition, when the second compression spring 307 is in contact with the hold releasing rod 308, the hold-down claw 304 is unlocked to leave a clearance between the top face of the rear plate 273 and the hold-down claw 304. The clearance is set to an amount large enough for the spacer 74 to be inserted in the lateral direction. In other words, the relation between the first tension spring 306 and the second compression spring 307 is set such that the hold-down force F1 working on the claw 304 is minimum while the spring 307 is in contact with the hold releasing rod 308. Thereafter, the hold releasing rod 308 is lowered to gradually increase the hold-down force F1. As the hold-down force F1 reaches the maximum level, the hold-down claw 304 is brought into contact with the spacer 74 on the rear plate 273 to maintain the tension given by the first tension spring 306.

In this way, only a small force is needed to bring the spacer hold-down mechanism 7 into contact with the spacer 74, which has been transported and brought into contact with the rear plate 273 by the hands. Accordingly, the spacer 74 is prevented from leaving the position where it is aligned.

The claw 304 is provided with an adhesive application hole 309 in order to apply an adhesive after the spacer 74 is pressed against the rear plate 273 to be removed from the spacer joining device 1.

(Adhesive Application Step)

Through the above steps, all the spacers 74 are positioned and fixed to the rear plate 273 by the rear plate jig 6. The rear plate 273 is then sent to an adhesive application step.

In this step, an adhesive is applied to an adhesive application hole 75*b* on each end of the spacer unit 75. A transfer method is employed to apply the adhesive for the reason given below.

The adhesive is obtained by dispersing an aggregate, particles each having a diameter of a few μm to a hundred μm, in a solvent. In general, a dispenser method is frequently used to apply an adhesive. When the particle size is large as in this adhesive, a large diameter needle (ϕ1.4 or larger) is necessary for stable application of the adhesive. As the needle diameter becomes larger, the minimum ejection amount ejected in one shot is accordingly increased.

However, the minute amount of adhesive of 2 to 3 mg is enough to obtain the necessary strength by adhesion. It is impossible for any dispenser method to eject this minute amount of adhesive steadily. Not to mention to obtain a thin adhesive layer after application. The thickness of the adhesive layer is greatly influenced by the period of time the adhesive takes to dry. An adhesive cures by vaporizing moisture from the surface that is in contact with the outside air and therefore it takes longer to dry if there is more thickness to cure. Accordingly, the adhesive has to be applied thinly. For that purpose, the adhesive has to be applied by the transfer method.

(Adhesive Drying and Curing Step)

The rear plate 273 with the adhesive applied to the adhesive application hole 74*b* in the above step is still set in the rear plate jig 6 and is transported into a vacuum drying furnace for an adhesive drying and curing step.

Figure 15:
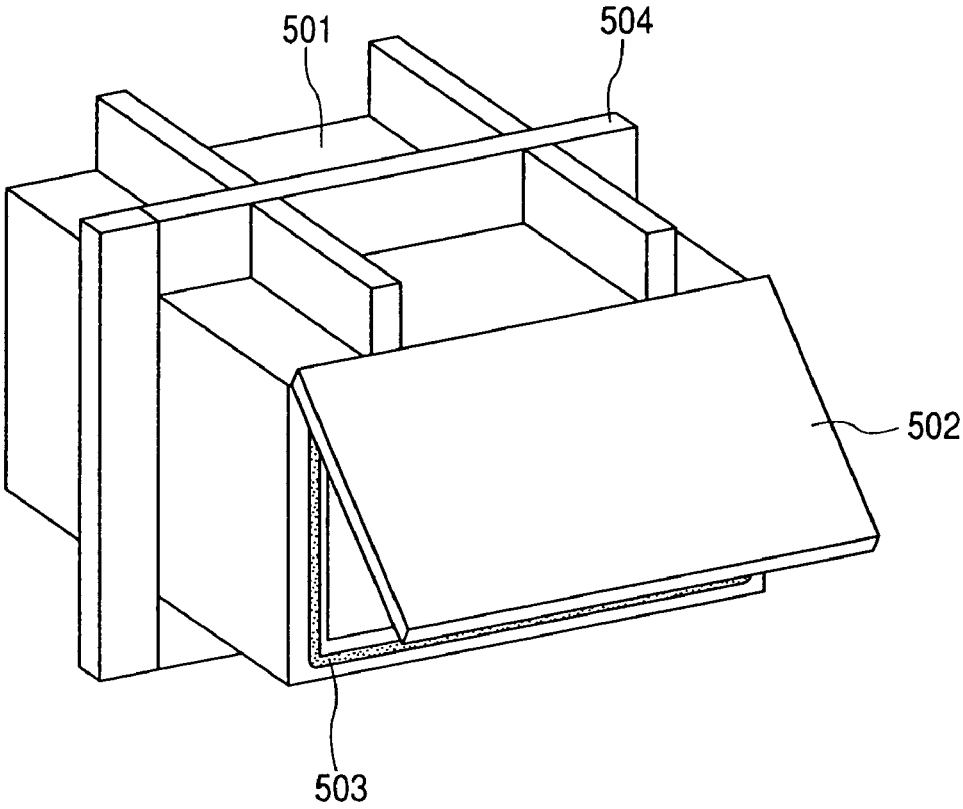
FIG. 15 is a full view of a vacuum drying furnace viewed at an angle.

FIG. 15 is a full view of a vacuum drying furnace used in this step.

In FIG. 15, Reference Symbol 501 denotes a case which gives a shape to the vacuum drying furnace. Reference Symbol 502 represents a lid for putting in and out the rear plate jig 6 on which the rear plate 273 is placed. Reference Symbol 503 represents an O ring interposed between the case 501 and the lid 502 to maintain the airtightness. A rib 504 runs along the circumference of the case 501, thereby preventing the case 501 from losing its shape due to the pressure difference between the inside and outside of the case 501 when vacuumed.

The material of the case 501 is metal (for example, stainless steel or aluminum) or acrylic. In the case that the case 501 is formed of metal, welding, adhesion, or O-ring joining can be employed as the bonding method. While in the case that the case 501 is acrylic, adhesion or O-ring joining is employed. A not-shown vacuum source for vacuuming is connected to the vacuum drying furnace.

The vacuum drying furnace used in this step is for vaporizing moisture contained in the adhesive at room temperature (22 to 24° C.). Therefore, the ultimate vacuum of the furnace is 4 to 20 Torr (approximately 533 to 2,666 Pa), or if the moisture vaporizing efficiency is to be raised, 0.1 Torr (approximately 13 Pa). This level of ultimate vacuum is sufficiently reached by a rotary pump, and an inexpensive vacuum source will suffice. The vacuum is maintained for 8 to 12 minutes.

At this ultimate vacuum and vacuum maintaining period of time, the minimum adhesion (=temporary fixing) is obtained which is strong enough to prevent the spacer 74 from shifting or peeling off the rear plate 273 even when a mechanical external force is applied during subsequent transportation or removal of the spacer hold-down mechanism 7.

Figure 16:
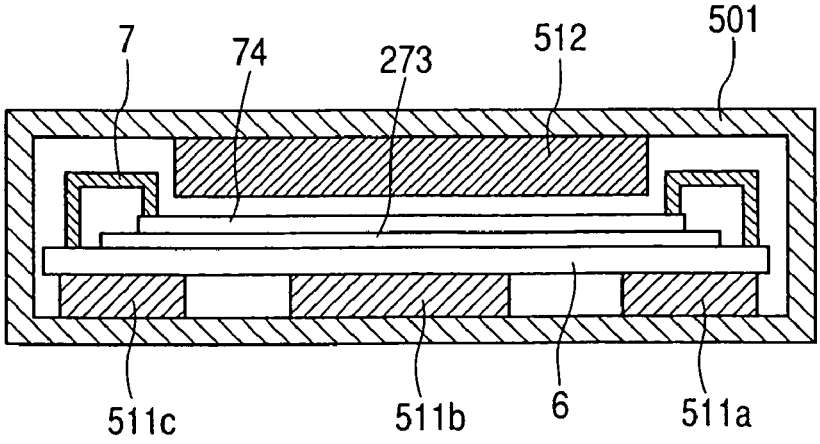
FIG. 16 is a sectional view showing an interior of the vacuum drying furnace.

FIG. 16 shows an interior of the vacuum drying furnace used in this step.

In FIG. 16, a case 501 is identical with the case in FIG. 15. Inside the case 501, the rear plate jig 6 is positioned on rear plate jig supporting posts 511*a* to 511*c*, which support the rear plate jig 6, and the rear plate 273 is placed on the positioned rear plate jig 6. The spacer hold-down mechanism 7 attached to the rear plate jig 6 regulates the position of the spacer 74 on the rear plate 273.

A volume occupying block 512 protrudes from the case 501 toward the rear plate 273. The volume occupying block 512 is provided in order to reduce the gas volume in the case 501 as much as possible. This makes it possible to exhaust the interior of the case 501 by a rotary pump (not shown in the drawing) that serves as a vacuum source in a short period of time.

The rear plate jig supporting posts 512*a* to 512*c* are separated from one another as shown in the drawing. This is to allow a forked portion of a handling carriage dedicated to transportation of the rear plate jig 6 to enter the case 501, so that the rear plate jig 6 is passed between the handling carriage and inside of the vacuum drying furnace.

Given below is the reason why vacuum drying is employed in this step.

Twenty spacers 74 in total are positioned on the rear plate 273, and the positions of the spacers 74 are regulated by the spacer hold-down mechanisms 7 protruding from the rear plate jig 6. The necessary accuracy in positioning the spacer 74 on the rear plate 273 is on the order of a few μm. In addition, the rear plate 273 and the spacer 74 are very large in size (the rear plate 273 is approximately 1,000 mm×600 mm and the spacer 74 measures approximately 800 mm in length).

This makes it impossible to heat the adhesive alone during heating for curing the adhesive, and portions of the rear plate 273 and the spacer 74 that are in the periphery of the adhesive are also raised in temperature. When the temperature of the rear plate 273 is raised, the rear plate 273 itself becomes larger due to thermal expansion. The rear plate 273 is increased in size by approximately 4 μm as the temperature of the rear plate 273 is raised by 1° C. Accordingly, when heated at 200° C., which is a temperature necessary to fully cure the adhesive, the rear plate 273 shifts from the position before the heating by dozens of μm. In addition, the glass plate is deformed unevenly by heating. Since it is impossible to make the rear plate jig 6 and the spacer hold-down mechanism 7 conform to changes in the rear plate caused by the thermal expansion, the positional accuracy of the spacer 74 relative to the rear plate 273 is lowered.

For that reason, vacuum drying is needed as a process for drying the adhesive in place of heating. The step of curing the adhesive by vacuum drying is described below.

The rear plate 273 to which the spacers 74 are temporarily fixed is advanced to a step of removing the rear plate jig 6. The rear plate jig 6 is detached from the rear plate 273 at this point in order to prevent expansion of the rear plate 273 and the spacer 74 due to subsequent heating from shifting the position of the rear plate jig 6 with respect to the rear plate 273 and to prevent the stress caused by the positional shift from exceeding the destruct line and breaking the spacer 74.

The rear plate 273 thus detached from the rear plate jig 6 is sent to a heating step. In the heating step, the adhesive is heated to be cured thoroughly. The heating step may employ spot heating in which hot air is blown directly to the adhesive or the adhesive is irradiated with a light beam. Alternatively, overall heating may be employed in which the adhesive is heated and cured in an electric furnace or the like. The heating raises the adhesion of the adhesive to a level that allows the spacer 74 to keep position of the spacer 74 during subsequent transportation and the following steps. The above-described inconvenience resulting from thermal expansion differences between the rear plate, the rear plate jig 6 and the spacer hold-down mechanism 7 is not a problem, since the rear plate jig 6 and the spacer hold-down mechanism 7 are removed from the rear plate 273 in the heating step.

As the above steps are finished, all the spacer assembling steps are completed.

According to this embodiment, spacers are installed using a spacer joining device in which plural pairs of hands are provided so that both ends of a spacer are gripped in one pair of hands, one hand of a pair is fixed while the other hand of the pair receives a tension along a linear guide from a spring force in order to separately apply a certain level of tension to each spacer, each hand is separately guided upward and downward and brought into contact with a rear plate in a manner that conforms to the surface irregularities of the rear plate, and each hand loses the weight utilizing a counter plummet and is brought into contact with the rear plate surface with a minimum force to thereby avoid damage to the spacers. As a result, the following effects are obtained:

1) The bottom face of each spacer can be brought into contact with the rear plate in a manner that conforms to irregularities of the contact face of the rear plate.

2) The impact upon contact is minimized to minimize damage to the spacers and to the contact face of the rear plate.

3) Plural spacers are simultaneously installed and therefore the assembly period of time can be shortened (or the tact is improved).

The spacers are thus joined to the rear plate efficiently with high accuracy.

This embodiment describes a case of using plural pairs of hands (five pairs, for example). The same mechanism and structure can be used to install, for instance, one spacer in one work step when only a small number of spacers are to be installed, or under similar circumstances. In this case also, application of the present invention provides the following effects:

1) The bottom face of each spacer can be brought into contact with the rear plate in a manner that conforms to irregularities of the contact face of the rear plate.

2) The impact upon contact is minimized to minimize damage to the spacers and to the contact face of the rear plate.

As described above, the present invention can provide a method of manufacturing an image display device in which long spacers are efficiently joined between a pair of substrates with high accuracy by simultaneously gripping the plural spacers in an array of plural hands and simultaneously installing the spacers with high accuracy. The hands are paired and each pair grips both ends of one spacer. The hands apply a certain level of tension to the spacers. The hands on each end conform to surface irregularities of a face on which the spacers are to be placed, thereby minimizing the load that is in contact with the face on which the spacers are to be placed.

What is claimed is:

1. A method of manufacturing an image display device that has a plurality of spacers for keeping a gap between a pair of substrates, comprising steps of:

gripping each of the spacers at both ends in a longitudinal direction of each spacer with one pair of a plurality of pairs of hands;

installing the plural spacers on one of the pair of substrates while exerting a tensile force to the gripped plural spacers;

applying an adhesive to the plural spacers installed on the one substrate, to tentatively fix by the adhesive the plural spacers to the one substrate; and heating the adhesive so that the plural spacers tentatively fixed to the one substrate are finally fixed to the one substrate.

2. A method of manufacturing an image display device according to claim 1, wherein, during the installing of the spacers, both ends of the gripped plural spacers are pressed to the one substrate by a spacer pressing mechanism.

3. A method of manufacturing an image display device according to claim 1, wherein, during the tentatively fixing, the adhesive applied to the installed plural spacers is held within an atmosphere of reduced pressure for a predetermined time period to tentatively fix the installed plural spacer to the one substrate.

4. A method of manufacturing an image display device according to claim 2, wherein, during the tentatively fixing, the adhesive applied to the installed plural spacers is held within an atmosphere of reduced pressure for a predetermined time period to tentatively fix the installed plural spacer to the one substrate.

5. A method of manufacturing an image display device according to claim 1, wherein each hand that grips an end of the spacers can independently move in a direction of a line normal to the one substrate, and the step of installing can be performed by the hand.

6. A method of manufacturing an image display device according to claim 2, wherein each hand that grips an end of the spacers can independently move in a direction of a line normal to the one substrate, and the step of installing can be performed by the hand.

7. A method of manufacturing an image display device according to claim 3, wherein each hand that grips an end of the spacers can independently move in a direction of a line normal to the one substrate, and the step of installing can be performed by the hand.

8. A method of manufacturing an image display device according to claim 4, wherein each hand that grips an end of the spacers can independently move in a direction of a line normal to the one substrate, and the step of installing can be performed by the hand.

* * * * *